US009651299B1

(12) United States Patent
Duff et al.

(10) Patent No.: US 9,651,299 B1
(45) Date of Patent: May 16, 2017

(54) APPARATUS AND METHOD FOR BEVERAGE CONTAINER COOLER WITH DEFLECTED COMPLIANT SEAL

(71) Applicants: Scott B. Duff, Round Rock, TX (US); Daniel F. Caputo, Leander, TX (US); Roy Paul Prosise, Cedar Park, TX (US)

(72) Inventors: Scott B. Duff, Round Rock, TX (US); Daniel F. Caputo, Leander, TX (US); Roy Paul Prosise, Cedar Park, TX (US)

( * ) Notice: Subject to any disclaimer, the term of this patent is extended or adjusted under 35 U.S.C. 154(b) by 473 days.

(21) Appl. No.: 14/172,412

(22) Filed: Feb. 4, 2014

Related U.S. Application Data

(60) Provisional application No. 61/830,119, filed on Jun. 2, 2013.

(51) Int. Cl.
*F25D 3/08* (2006.01)
*F25D 31/00* (2006.01)

(52) U.S. Cl.
CPC ..... *F25D 31/002* (2013.01); *F25D 31/007* (2013.01); *F25D 2331/803* (2013.01); *F25D 2331/805* (2013.01)

(58) Field of Classification Search
CPC ..... F25D 31/007; F25D 31/008; F25D 2331/803; F25D 2331/805; F25D 2331/808
See application file for complete search history.

(56) References Cited

U.S. PATENT DOCUMENTS 5,271,244 A * 12/1993 Staggs ..... F25D 31/007 62/457.3
9,181,015 B2 * 11/2015 Booska ..... F25D 3/08

* cited by examiner

*Primary Examiner* — Orlando E Aviles Bosques
(74) *Attorney, Agent, or Firm* — Rick B. Yeager, Attorney

(57) ABSTRACT

A supplemental cooling device for a beverage container. Ice and water are introduced through a top opening in a housing which is wider than the outside diameter of the container, so the container is freely inserted into the housing. A lid assembly with a compliant seal is removably threaded to the housing. When in a relaxed and open position, the seal has an opening which is also wider than the outside diameter of the beverage container. After inserting the container, the lid assembly is tightened against the housing, and the compliant seal is deflected against the beverage container to isolate the annular space between the housing and beverage container, thereby allowing the housing and beverage container to be tipped for drinking without spilling the coolant. Once the drink is consumed, the compliant seal may be disengaged so that it is open again, permitting easy removal of the beverage container.

8 Claims, 8 Drawing Sheets

APPARATUS AND METHOD FOR BEVERAGE CONTAINER COOLER WITH DEFLECTED COMPLIANT SEAL

RELATED APPLICATIONS

This non-provisional US patent application is related to U.S. Provisional Patent Application No. 61/830,119 filed Jun. 2, 2013, and claims priority of that filing date.

BACKGROUND

Field of Invention

This invention relates to a method and apparatus for a beverage cooler to keep beverage containers such as cans, bottles and cups chilled while allowing a user to drink from the beverage container without spilling a coolant such as ice or water used to provide the cooling.

Prior Art

Most consumers prefer to consume drinks such as soda and beer while they are cold. Canned or bottled drinks which have been chilled in ice chests or refrigerators begin to warm as soon as they are removed from the chilled environment. On summer days in particular, drinks warm up very quickly in the hot sun.

Products have been designed to slow the heating up process. Many consumers insulate their can or bottle with a wrap such as neoprene or foam. Millions of these have been sold, proving consumers have a desire to keep their drinks cold. However, this wrap simply insulates—it provides no refrigeration or cooling of the beverage.

One product which attempts to refrigerate the beverage is a double walled mug which has a refrigerant between the walls. This refrigerant can be frozen or chilled in a freezer prior to use. When the mug is removed from the freezer, drinks may be poured into the mug to help them stay cold. To use this mug, the consumer must plan ahead to freeze the mug for a period of time before using. This mug also eventually needs to be re-frozen before re-use by returning it to a chilled environment, the best being an electrical freezer. This takes planning and time between uses. This product is therefore not very practical for several reasons for people outdoors drinking beverages or multiple beverages from cans or bottles which are taken from an ice chest.

One device has been designed to emulate ice chests to keep drinks cold while they are consumed. This device features a housing into which ice water can be introduced and then a can or bottle can be inserted. A seal subassembly is slid over the can or bottle and then attached to the housing sealing the annular space between the housing and can or bottle so that the consumer may tip the housing and drink from the can or bottle without the ice water spilling out. After finishing the beverage, the user must release the subassembly from the housing, remove the can or bottle and then slide the seal containment means off the can or bottle in order to use again.

SUMMARY

The current invention permits a user to place a beverage container, such as a can, bottle or cup into a housing along with a water based coolant such as ice and water, and to periodically drink from the beverage container.

In one embodiment, a compliant seal is part of a lid assembly which can be secured to the housing by an attachment feature such as threads, a snap, or a quarter-turn lock. The compliant seal has a sufficient diameter to allow the free insertion of the beverage container when in a relaxed, open orientation. After inserting the beverage container, the attachment feature permits the lid assembly to be secured and tightened onto the housing. As the lid assembly is tightened, the compliant seal is deflected or redirected to an engaged orientation, thereby forming a circumferential seal against the beverage container which closes the annular space between the housing and the beverage container. This sealing of the annular space permits the user to tip the housing and drink from the beverage container without spilling the coolant. Once the drink is finished, the user may loosen the lid assembly, and thereby return the seal to a relaxed and open orientation to allow easy removal of the beverage container.

Since the compliant seal may be opened and closed without removing the lid assembly from the housing, beverage containers may be inserted and removed from the housing without having to go through multiple steps and difficulties to do so.

DESCRIPTION OF EMBODIMENT

Figure 1:
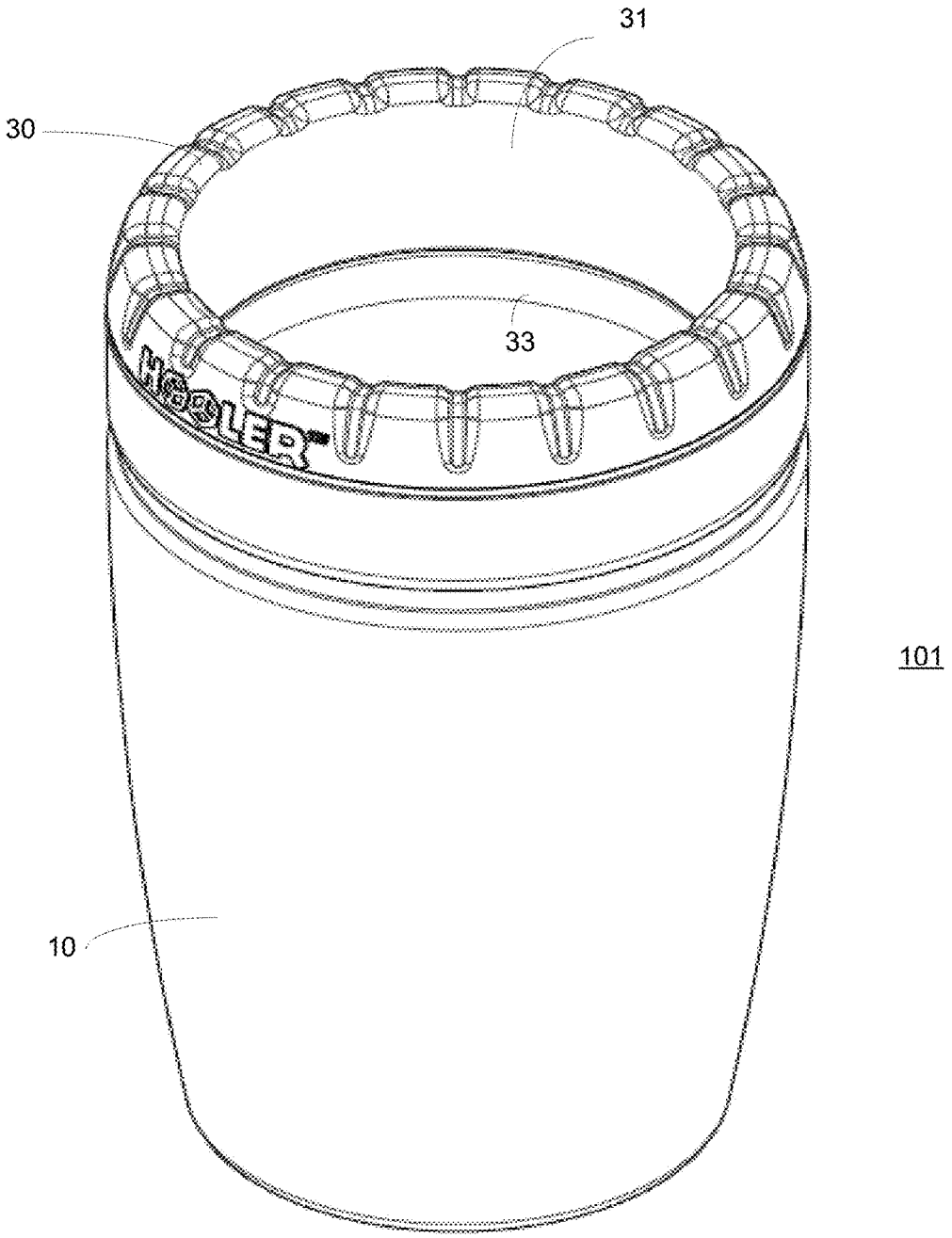
FIG. 1 is a top perspective view of one embodiment of a cooler for the beverage container comprising a lid assembly and a housing.

Threaded Housing Attachment with Elongated Annular Compliant Seal

In this specification, the term "beverage container" means a container for holding a liquid. The container may be, but is not limited to a can, bottle, or cup.

In this specification, the term "housing" means a holder for a water based coolant and a beverage container.

In this specification, the term "water based coolant" means water, ice, ice and water or water with pre-frozen packets.

In this specification, the term "lid assembly" means a top assembly which can be attached to the housing.

In this specification, the term "open top" means a portion of the lid assembly with an opening into which a portion of a beverage container can be inserted.

In this specification, the term "lid assembly attachment feature" means a coupling feature whereby the lid assembly may be attached and secured onto the housing. The lid assembly attachment feature may be, but is not limited to threads, a snap, or a quarter-turn lock.

In this specification, the term "compliant seal" means a compliant material which forms a circumferential seal when engaged against the outside of the beverage container. The complaint seal may be but is not limited to rubber or polymers, such as elastomers, polyurethane, or silicone.

In this specification, the term "elongated annular compliant seal" means a compliant seal that is deformable with respect to its vertical axis so that the distal end of the compliant seal may be deflected or redirected toward the container as the lid assembly is attached and secured onto the housing. In one example, the compliant seal has a downwardly extending length which is greater than the width of attachment to the lid assembly.

In this specification, the term "seal deflection element" means an angled feature on or near the interior of the housing which deflects or re-directs the elongated annular compliant seal toward the beverage container.

In this specification, the term "O-ring annular compliant seal" a compliant seal whereby the engagement against the beverage container is provided by compression of the seal.

In this specification, the term "open relaxed orientation" means the inner diameter of the compliant seal is of sufficient diameter that a beverage container can be inserted through it with little or no resistance.

In this specification, the term "engaged orientation" means the compliant seal is in contact circumferentially with the beverage container.

In this specification, the terms "quarter-turn feature" or "quarter-turn lock" refer to a fastening system between the lid assembly and the housing whereby the lid assembly is pushed down onto the housing and rotated to secure the lid assembly on the housing. In one example, a plurality of spiral undercuts are provided on the housing, so that the spiral undercuts engage bosses provided on the lid assembly.

In this specification, the term "proximal end" means the portion of the compliant seal attached to the lid assembly, and the term "distal end" means the unattached end of the compliant seal opposite of the proximal end.

In this embodiment, a cooler for a beverage container comprises a lid assembly which can be secured onto a housing and tightened by threads. An elongated annular compliant seal is provided as part of the lid assembly, and a seal deflection element is provided on the housing. The elongated annular compliant seal has an initial open and relaxed orientation wherein the opening of the elongated annular compliant seal is large enough to permit easy insertion of a beverage container through the elongated annular compliant seal and into the housing. As the lid assembly is tightened onto the housing, the distal end of the elongated annular compliant seal is deflected by the seal deflection element into a narrower diameter which circumferentially seats the elongated annular compliant seal against the beverage container at or near the distal end of the elongated annular compliant seal, thereby sealing the annular space between the container and the inner wall of the housing.

FIG. 1 is a top perspective view of one embodiment of a cooler 101 for a beverage container comprising a lid assembly 30 and a housing 10. The lid assembly has an open top 31 for inserting a beverage container; and a compliant seal 33 which seals against the side of a beverage contained as the lid assembly is tightened against the housing.

Figure 2:
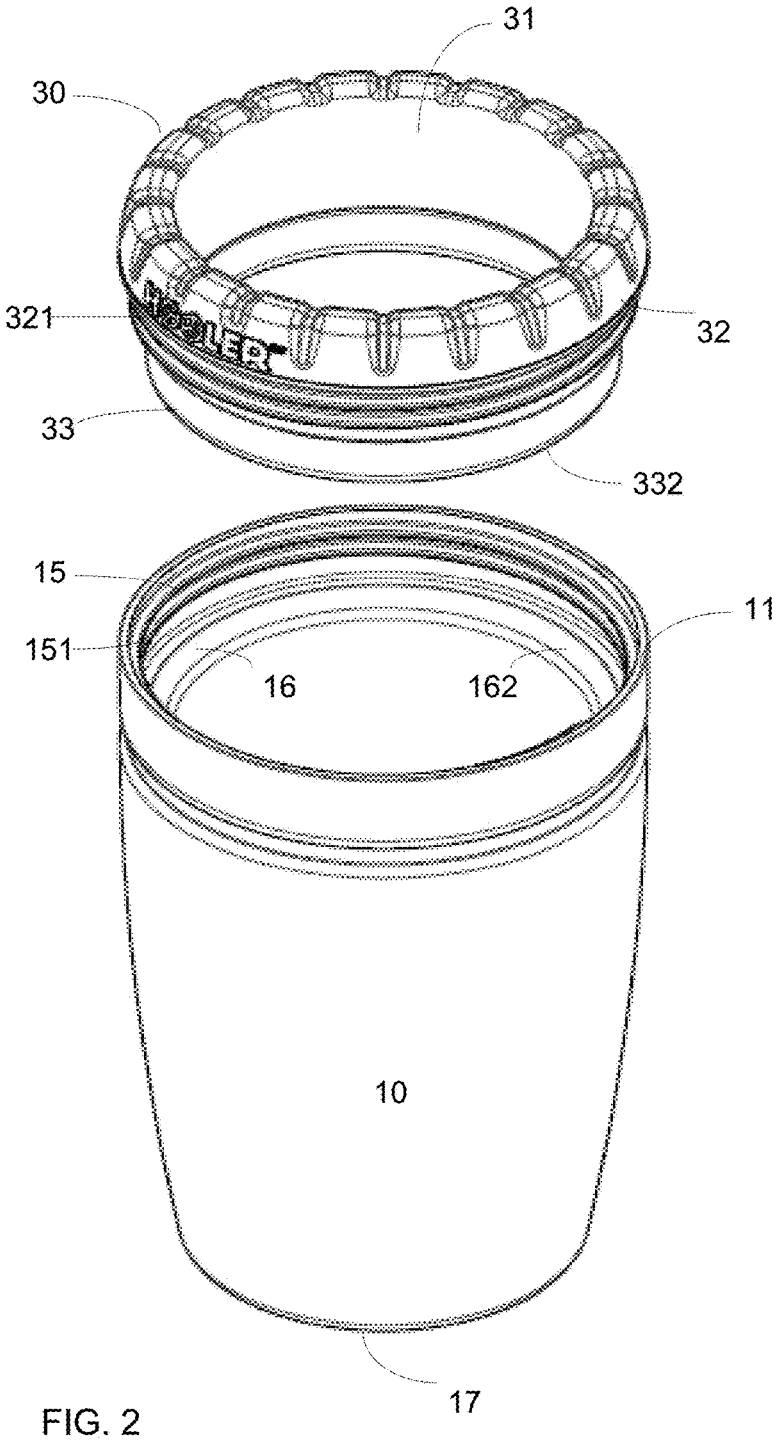
FIG. 2 is an exploded top perspective view of the cooler of FIG. 1.

FIG. 2 is an exploded top perspective view of the cooler of FIG. 1. The lid assembly 30 may be secured to the upper portion 11 of housing 10 and tightened against the housing attachment mating feature 15 with a lid attachment feature 32. In this example, the lid attachment feature is lid assembly threads 321 which mate with housing threads 151. In other examples, as described below, other lid attachment securing and tightening features may be used such as a snap or quarter-turn lock feature.

Figure 6:
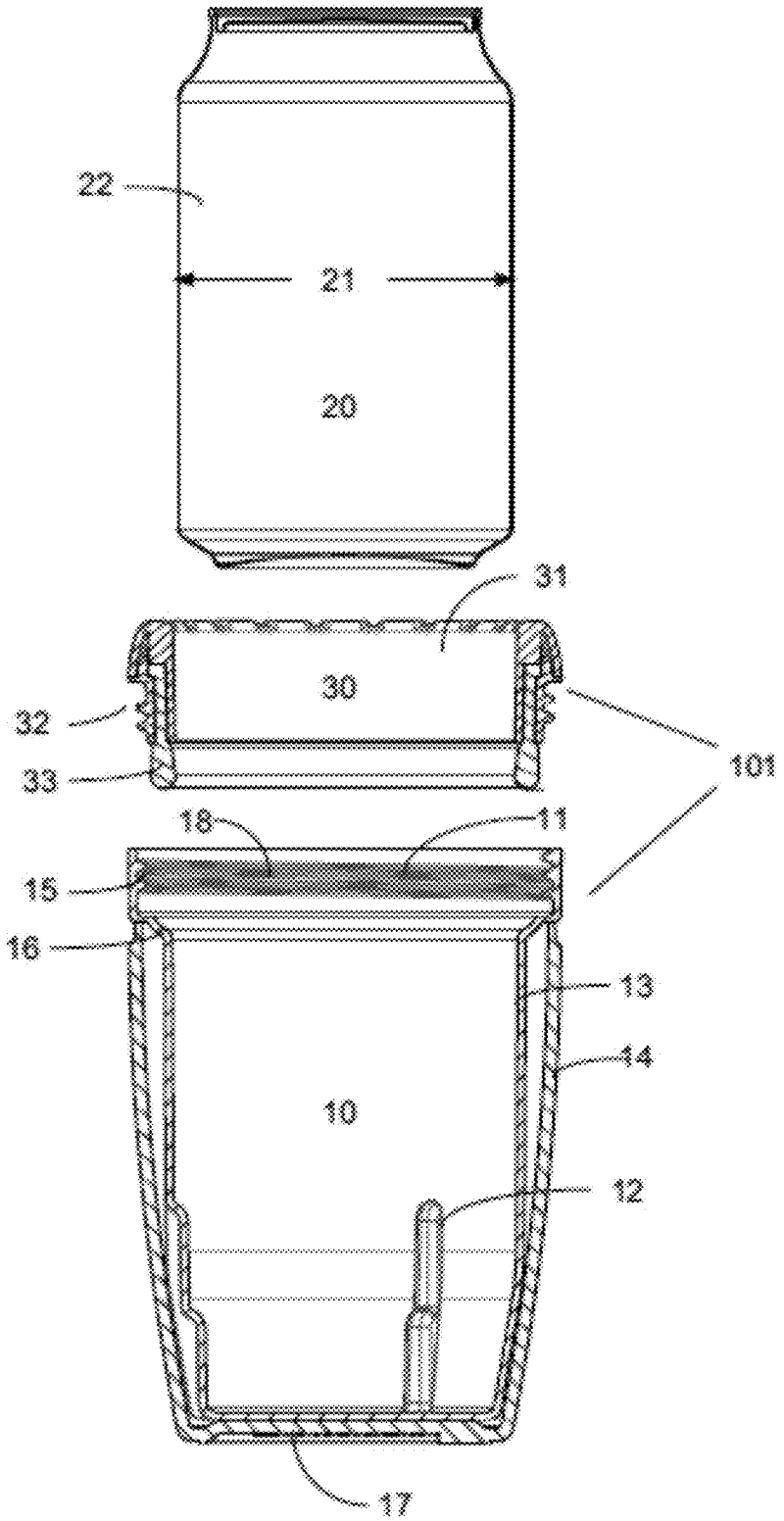
FIG. 6 is an exploded view of the cooler of FIG. 1 with a beverage container.

The lid assembly 30 has an open top 31 with a diameter slightly larger than the outer diameter 21 (FIG. 6) of a beverage container 20 (FIG. 6). In this example, an elongated annular compliant seal 33 is attached to the lid assembly at the proximal end of the seal. As the lid assembly 30 is tightened against the housing 10, the distal end portion 332 of the elongated annular compliant seal 33 is deflected against the beverage container by a seal deflection element 16 provided on the interior of the housing. In this example, the seal deflection element is an angled ledge 162 which projects downward and inward.

Figure 3:
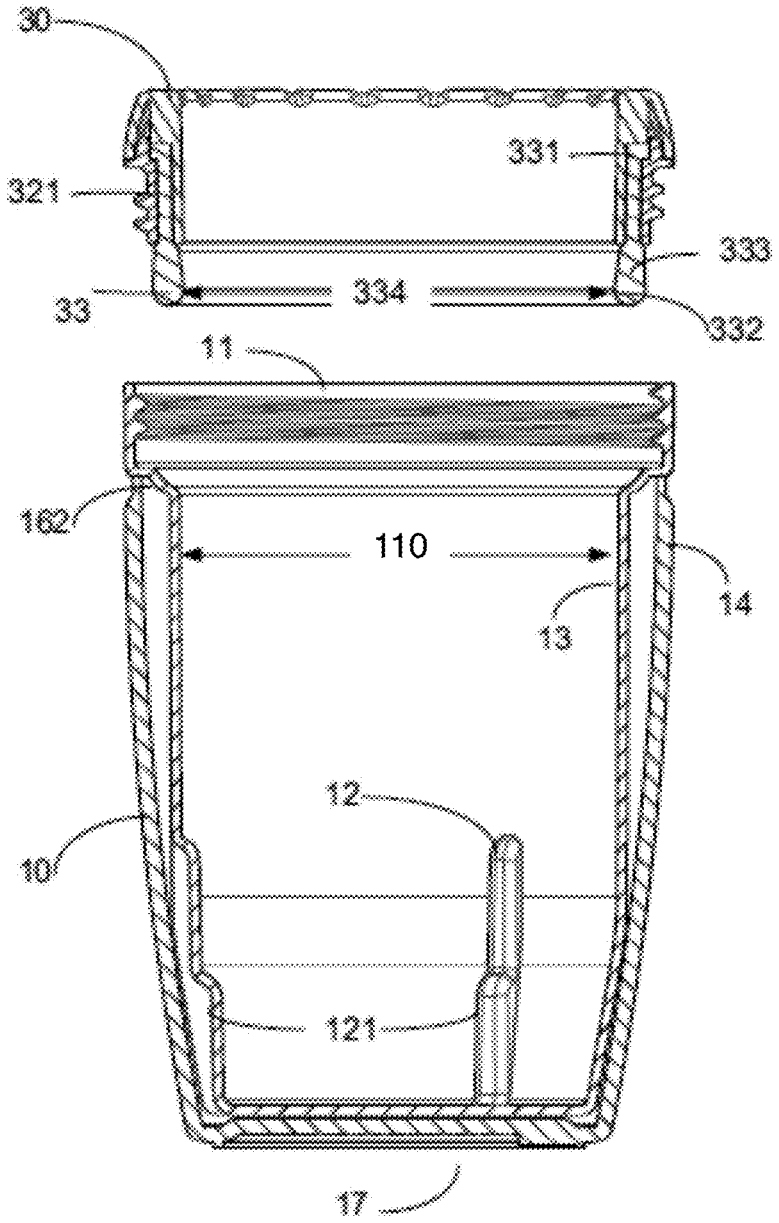
FIG. 3 is an exploded cross section view of the cooler of FIG. 1.

FIG. 3 is an exploded cross section view of the cooler of FIG. 1. The housing 10 includes an open top 11, a bottom 17, and a side wall. In this example, the side wall is a double wall comprising an inner side wall 13 and an outer side wall 14 which is spaced apart from the inner side wall. The double wall provides insulation for the beverage container and water based coolant. The inner side wall has a diameter 110 greater than the beverage container diameter so that an annular space is provided between the inner side wall and the beverage container.

The housing includes a container support 12. In this example, the container support is provided by three equally spaced ribs 121 projecting inward from the inner side wall of the housing. The ribs support the container above the bottom of the housing to permit a water based coolant below the beverage container. In other examples, other support means such as one or more pedestals or an inner side wall which narrows to the diameter of the container may be used to support the container above the bottom. In other embodiments, no container support means is provided. In this example, a portion of the the annular compliant seal 333 is positioned in recess 331 in the lid assembly 30.

FIG. 3 shows the elongated annular compliant seal 33 in an open relaxed orientation 333 where the inside diameter 334 of the complaint seal is greater than the diameter of the beverage container, thereby permitting easy insertion and removal of the beverage container.

Figure 4:
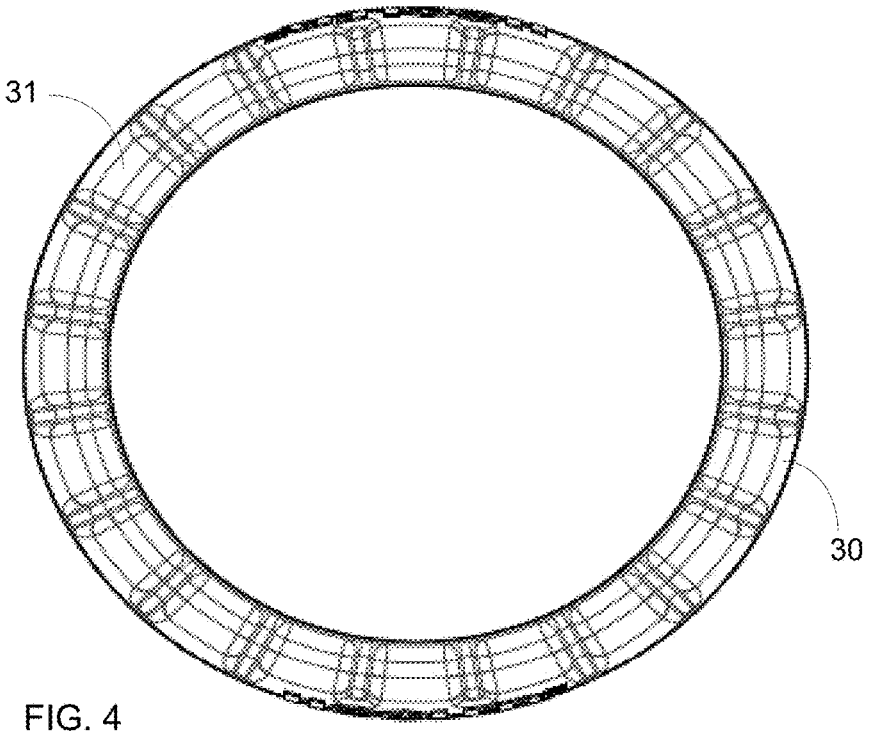
FIG. 4 is a top view of the lid assembly of the cooler of FIG. 1.

FIG. 4 is a top view of the open top 31 for the lid assembly 30 of the cooler of FIG. 1 with the compliant seal in an open orientation below the top portion of the lid assembly.

Figure 5:
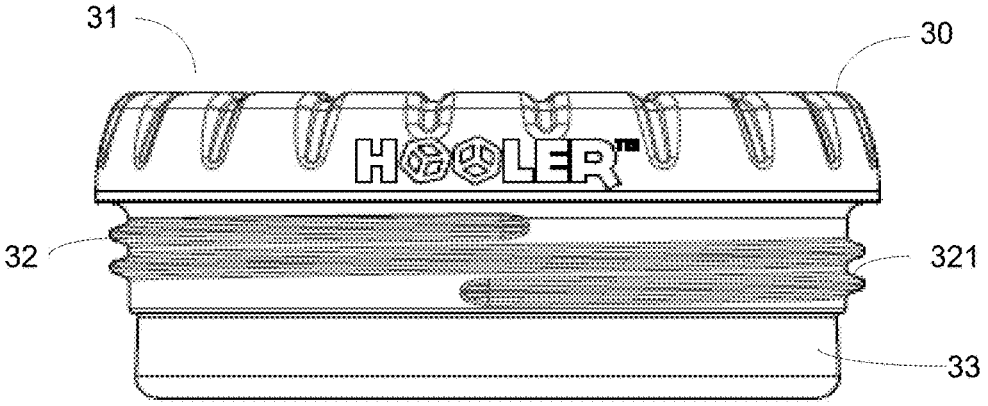
FIG. 5 is a side view of the lid assembly of the cooler of FIG. 1.

FIG. 5 is a side view of the open top 31 for the lid assembly 30 of the cooler of FIG. 1. In this example, the lid assembly attachment feature 32 is threads 321 which mate to housing threads 151 (not shown). The compliant seal 33 is in an open orientation.

FIG. 6 is an exploded view of the cooler 101 with a beverage container 20. In this example, the beverage container is a can 22 which may be inserted through the top opening 31 of the lid assembly and top opening 18 of the housing. In other examples, the beverage container is a bottle, cup, or other container. The beverage container has an outside diameter 21, and the cooler is designed to provide a seal against that outside diameter so that a water based coolant such as ice, ice and water, or pre-frozen packets are contained between the housing and the beverage container in order to provide cooling to the beverage container.

Figure 7:
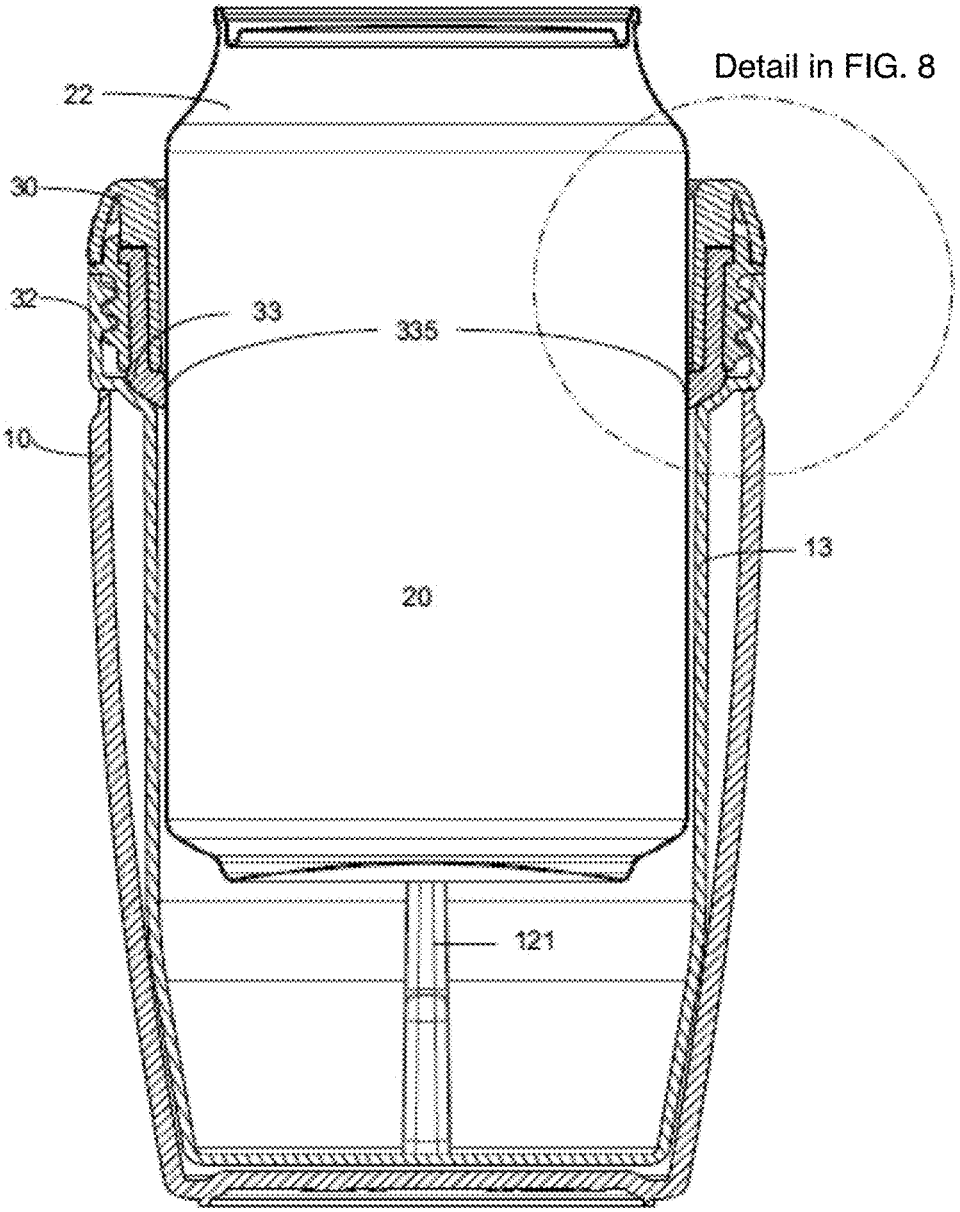
FIG. 7 is a cross-sectional side view of the cooler of FIG. 1 with an elongated annular compliant seal in an engaged orientation against a beverage can.

FIG. 7 is a cross-sectional side view of the cooler 101 of FIG. 1 with the elongated annular compliant seal 33 in an engaged orientation 335 against a beverage can 22.

Figure 8:
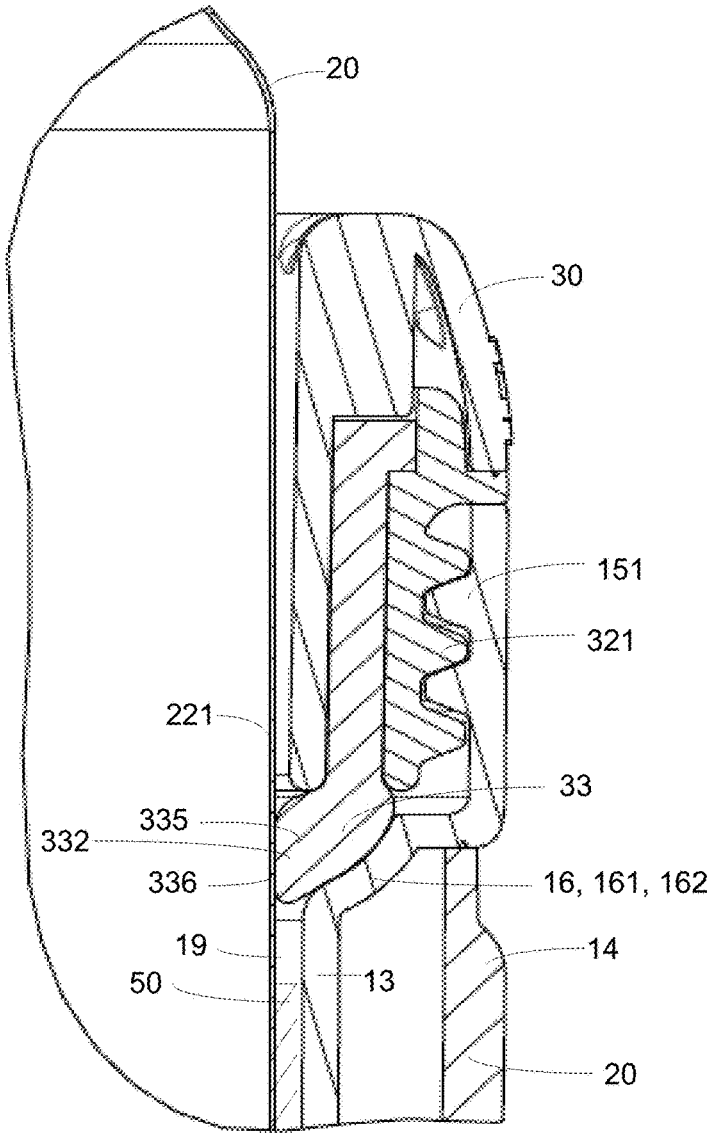
FIG. 8 is a detailed cross-sectional side view of the cooler of FIG. 1 with an elongated annular compliant seal in an engaged orientation against a beverage can.

FIG. 8 is a detailed cross-sectional side view of the cooler of FIG. 1 with the elongated annular compliant seal 33 in an engaged orientation 335 against a beverage can. As the lid assembly 30 is tightened against the housing with lid assembly threads 321 engaging housing threads 151, the elongated annular compliant seal 33 is deflected by angular ledge 162 so that the distal end 332 of the elongated annular compliant seal 33 is an engaged orientation 335 against the container sidewall 221, and thereby forms a circumferential seal 336 to contain a water based coolant 50 in the annular space 19 between the container sidewall 221 and the housing inner side wall 13.

In FIG. 8, the seal deflection element 16 is a ledge 161. In this example, an angled ledge 162 has a concave-upward profile and a downward angle of about 45 degrees. In this embodiment, an elongated complaint seal is deflected against the side wall of the beverage container to form a circumferential seal of the annular space between the inner side wall of housing and the side wall of the beverage container. In other examples, other seal profiles, seal deflection elements or ledge profiles may be used.

Prior to inserting the beverage container, a water based coolant such as ice, ice water or pre-frozen packets is inserted into the housing. A beverage container is then inserted into the housing so that it resides mostly within the housing and contacts the coolant which is below and around the beverage container.

In this example, the lid assembly is attached by threads on the inner wall of the housing and threads on the outside of the open top lid assembly. In other embodiments, the threads may be on the inside of the lid assembly and outer side wall of the housing. The elongated annular compliant seal 33 is attached to the open top of the lid assembly and hangs in a primarily vertical orientation relative to the open top while in a relaxed and open position. The inner diameter of the seal is wider than the outside diameter of the beverage container in order to allow the beverage container to be inserted through the seal.

After the beverage container is inserted, the open top of the lid assembly is tightened downward onto the housing until the elongated annular compliant seal contacts the seal deflection element 16 on the inner side wall of the housing. In this embodiment the seal deflection element is a ledge integral to the inner wall of the housing. This seal deflection element changes the orientation of the elongated annular compliant seal, redirecting the distal end 34 of the elongated annular compliant seal 33 inward until it contacts and forms a seal against the beverage container at or near the distal end of the elongated annular compliant seal. The threaded connection between the housing and open top of the removable lid portion coupled with this circumferential seal of the elongated annular compliant seal against the beverage container allows the housing to be tilted without spilling the coolant from the annular space between the housing and the beverage container.

As the open top is threaded downward onto the housing, the opening at the distal end of the elongated compliant seal is reduced through a range of various diameters. Once the inner diameter of the elongated annular compliant seal is sufficiently small enough to form a water tight circumferential seal against the beverage container, no more threading is needed. In this manner, the range of threading allows the same elongated annular compliant seal to be used with multiple diameters of cans, bottles and cups.

Method of Use

In one example of use, a cooler is provided as described above with a housing and a lid assembly.

The housing comprises an upper portion with a top opening configured to accept a water based coolant and a beverage container; an inner side wall of sufficient diameter to create an annular space between the inner side wall and the beverage container whereby the water based coolant may also directly contact a portion of the beverage container; and an angled ledge seal deflection element. The lid assembly comprises an open top configured to accept the beverage container; a threaded attachment feature, such that the attachment features permits the open top to be secured and tightened against the housing; and an elongated annular compliant seal having a proximal end attached to the open top, a distal end, an open relaxed orientation and an engaged orientation.

A water based coolant such as ice, ice and water, or pre-frozen packets is placed in the housing.

A beverage container is partially inserted into the housing while the elongated annular complaint seal is in a relaxed orientation; and the lid assembly is secured to and tightened against the housing by turning the lid assembly and engaging the threads on the lid assembly with mating threads provided on the housing. This tightening forces the elongated annular compliant seal into the angled ledge seal deflection element so that the distal end of the elongated annular compliant seal is deflected into the container side wall, thereby forming a circumferential seal against the beverage container.

After the beverage container contents are consumed, the lid assembly is partially loosened by turning the lid assembly, thereby raising the elongated annular compliant seal relative to the angled ledge seal deflection element and thereby moving the elongated annular compliant seal into an open relaxed orientation so that the beverage container is easily removed from the housing.

DESCRIPTION OF EMBODIMENT

Figure 9:
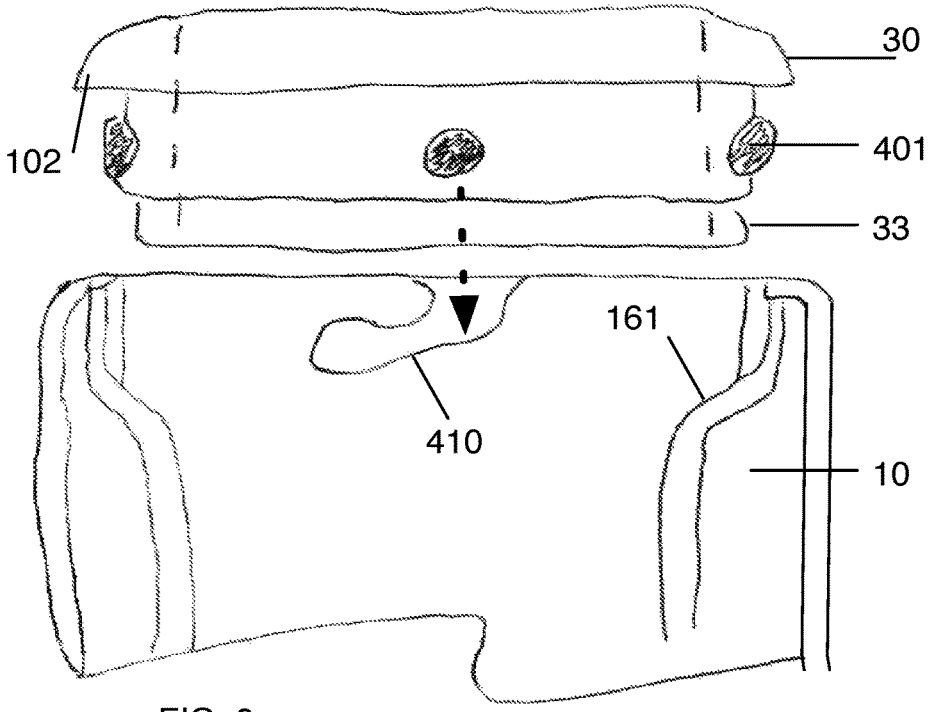
FIG. 9 is a side cross section view of another embodiment of a cooler for the beverage container.

Quarter Turn Locking Housing Attachment with Elongated Annular Compliant Seal FIG. 9 is a side cross section view of another embodiment 102 of a cooler for the beverage container. In this embodiment, four bosses 401 are equally spaced on lid assembly 30. Each boss mates with an undercut snap feature 410 on the housing 10 to tighten the lid assembly against the housing so that ledge 161 deflects a compliant seal 33 against a beverage container (not shown).

Figure 10:
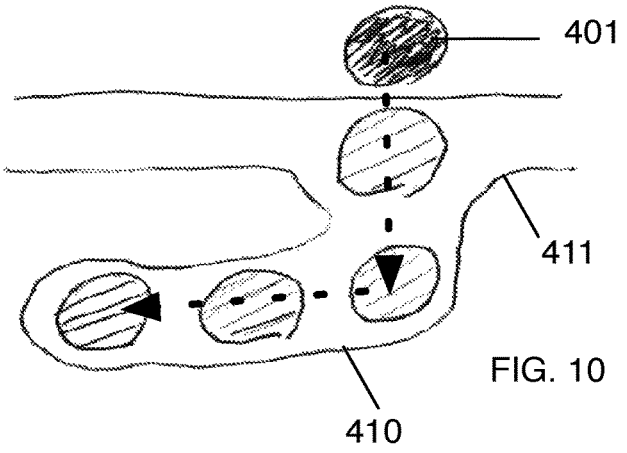
FIG. 10 is a detailed cross section view of a boss on the lid assembly of FIG. 10 mating with an undercut snap feature on the housing.

FIG. 10 is a detailed cross section view of a boss 401 on the lid assembly of FIG. 9 mating with an undercut snap feature 410 on the housing. The undercut snap feature 410 includes a lead in angle 411 to facilitate alignment of the lid assembly to the housing.

In this embodiment, the method of use is similar to the threaded lid assembly example as described above, except that the lid assembly comprises a quarter-turn lock feature so that the lid assembly is secured to and tightened against the housing by pushing the lid assembly onto the housing and rotating the lid assembly. This quarter-turn lock tightening forces the elongated annular compliant seal into the engaged orientation, and rotating the lid assembly back to its initial orientation relaxes the elongated annular compliant seal so that the container may be removed.

DESCRIPTION OF EMBODIMENT

Snap Housing Attachment with Elongated Annular Compliant Seal

In this embodiment, the open top of the lid assembly may be pushed downward, applying force to re-direct the elongated compliant seal inward as it is engaged by the seal deflection element until the elongated compliant seal contacts and forms a seal against the beverage container at or near the distal end of the elongated compliant seal. At this point, the lid assembly may be snapped into place using a snap mechanism on the upper portion of the housing.

In this embodiment, the method of use is similar to the threaded lid assembly example as described above, except that the lid assembly comprises a snap attachment feature so that the lid assembly is secured to and tightened against the housing by snapping the lid assembly onto the housing. This tightening forces the elongated annular compliant seal into the engaged orientation, and unsnapping the lid relaxes the elongated annular compliant seal so that the container may be removed.

DESCRIPTION OF EMBODIMENT

Threaded Housing Attachment with O-Ring Compliant Seal

In this embodiment, a compliant o-ring is used in place of the elongated seal. The various attachment methods tighten and secure the lid against the housing so that a portion of the o-ring is deflected against the side wall of the beverage container.

While exemplary embodiments of the invention have been described, it should be apparent that modifications and variations thereto are possible, all of which fall within the true spirit and scope of the invention. With respect to the above descriptions then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A cooler for a beverage container, the cooler comprising:

a housing comprising an upper portion with a top opening configured to accept a water based coolant and a beverage container such that a portion of the beverage container resides inside the housing, a bottom, and an inner side wall of sufficient diameter to create an annular space between the inner side wall and the beverage container whereby the water based coolant placed in the annular space will directly contact a portion of the beverage container, the inner side wall comprising internal lid attachment threads, a vertical portion offset inwardly from the internal lid attachment threads, and a seal deflection angled ledge located between the lid attachment threads and the vertical portion, the seal deflection angled ledge comprising a concave shaped upper surface tilting downward and inward relative to the open top of the housing; and a lid assembly comprising an open top configured to accept the beverage container, the open top comprising external threads configured to mate with the housing internal lid attachment threads, such that the threads permit the open top to be secured and tightened against the housing, an elongated annular compliant seal having a proximal end attached to the open top, and a distal end, the elongated annular complaint seal having an open relaxed orientation where the elongated annular compliant seal hangs downward relative to the open top, and the elongated annular compliant seal is configured to allow insertion of the beverage container, and an engaged orientation where the elongated annular compliant seal is deflected inward by the seal deflection angled ledge as the open top is secured and tightened against the housing, thereby causing the elongated annular compliant seal to engage the beverage container and form a circumferential seal at or in proximity to the distal end of the elongated annular compliant seal, thereby sealing the annular space between the inner side wall and the beverage container.

2. The cooler of claim 1, wherein the open top attachment feature is threads, such that mating threads for the open top are provided on an upper portion of the housing, and such that the elongated annular compliant seal is driven downwardly against the seal deflection element as the open top is threaded and tightened onto the housing.

3. The cooler of claim 1, wherein the housing further comprises an outer wall portion; and an inner wall portion spaced apart from the outer wall portion, the inner wall portion comprising the inner side wall.

4. The cooler of claim 1, wherein the beverage container is a can, bottle, or cup.

5. The cooler of claim 1, further comprising a decorative or insulating sleeve, such that the sleeve covers a substantial portion of the housing.

6. The cooler of claim 1, further comprising at least one beverage support means that supports the beverage container above the bottom of the housing, such that a portion of the water based coolant is positioned below the beverage container.

7. The cooler of claim 6, wherein the beverage support means is a plurality of ribs extending from the inner side wall.

8. The cooler of claim 1, wherein the water based coolant is ice and water, a pre-frozen packet or packets, or the combination of a pre-frozen packet or packets and water.

* * * * *